United States Patent [19]

Hasman

[11] 4,158,666

[45] Jun. 19, 1979

[54] STEARINE PRODUCTION

[75] Inventor: John M. Hasman, Chatham, N.J.

[73] Assignee: SCM Corporation, New York, N.Y.

[21] Appl. No.: 850,160

[22] Filed: Nov. 10, 1977

Related U.S. Application Data

[63] Continuation-in-part of Ser. No. 778,710, Mar. 17, 1977, abandoned.

[51] Int. Cl.[2] ..... C11C 3/12
[52] U.S. Cl. ..... 260/409
[58] Field of Search ..... 260/429

[56] References Cited

U.S. PATENT DOCUMENTS

| | | | |
|---|---|---|---|
| 2,307,065 | 1/1943 | Paterson | 260/420 |
| 2,357,352 | 9/1944 | Paterson | 260/409 |
| 2,413,009 | 12/1946 | Taussky | 260/409 |
| 3,856,710 | 12/1974 | Moulton et al. | 260/409 X |

OTHER PUBLICATIONS

Popescu et al., "High Oleic Oils by Selective Hydrogenation of Soybean Oils", JAOCS 46, pp. 97–99 (1969).

*Primary Examiner*—John Niebling
*Attorney, Agent, or Firm*—Jerry K. Mueller

[57] ABSTRACT

Glyceride oil is catalytically hydrogenated in rapid fashion to produce a stearine product.

14 Claims, 4 Drawing Figures

STEARINE PRODUCTION

CROSS REFERENCE TO RELATED APPLICATIONS

This application is a continuation-in-part of application U.S. Ser. No. 778,710, filed on Mar. 17, 1977 now abandoned. This application is cross-reference to commonly-assigned application U.S. Ser. No. 850,150, filed on even date herewith, which is a continuation-in-part of application U.S. Ser. No. 733,348, filed on Oct. 18, 1976 now abandoned. The disclosure of the above-listed applications are incorporated expressly herein by reference.

BACKGROUND OF THE INVENTION

This invention relates to a process for catalytically hydrogenating triglyceride oil and more particularly to hydrogenating in extremely rapid fashion oil to get a stearine product.

Heretofore it has been proposed to catalytically hydrogenate oil in the presence of nickel catalyst, copper-chromite catalyst (optionally metal oxide stabilized), or a combination of these two catalysts. Typically, the oil is touched-up to prevent rancidity or is made to a shortening consistancy-like product (Iodine Value suitably about 60–65) when the combination of the two catalysts is used. The feed oil also has been refined to remove contaminant soap and free fatty acid which tend to poison the catalysts and to render them ineffective in the hydrogenation process.

Applicant in copending application U.S. Ser. No. 733,348 described a hydrogenation process wherein glyceride oil contaminated with soap is rapidly and practically hydrogenated in the presence of nickel catalyst and of copper-chromite adjunct catalyst. The present invention provides an improvement to such process when making a stearine product.

SUMMARY OF THE INVENTION

Glyceride oil is catalytically hydrogenated with hydrogen gas in a hydrogenation zone under glyceride oil hydrogenation conditions to produce a hydrogenated oil product having an Iodine Value (IV) not substantially above about 30 in a two step process. Primary hydrogenation of the oil is conducted with greater than 0.2 weight-percent nickel hydrogenation catalyst and of greater than about 0.25 weight-percent copper chromite adjunct catalyst to an intermediate Iodine Value (IV) of the oil of at least about 10% less than the IV of the feed oil. Secondary hydrogenation then is conducted in the presence of between about 0.05 and 0.3 weight-percent nickel hydrogenation catalyst until the product has an IV less than the intermediate IV and not substantially above about 30, advantageously not above 10, and preferably not above 5.

Figure 1:
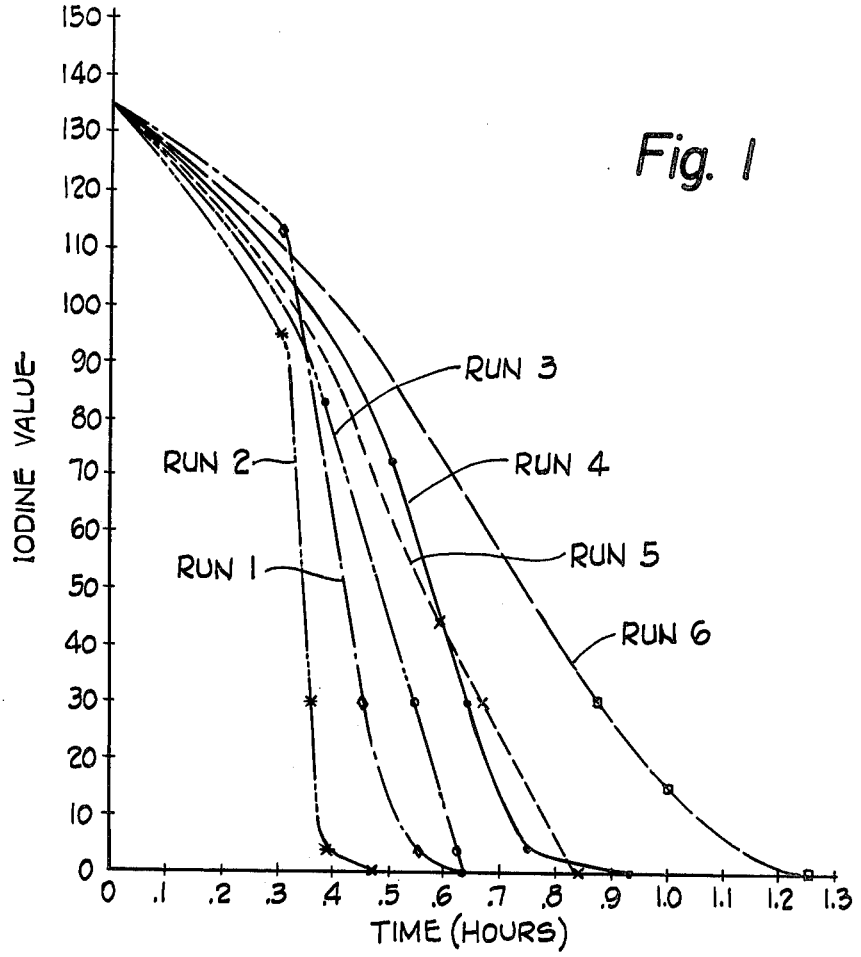
FIG. 1 is a scaled graph indicating the Iodine Value obtained in a series of six hydrogenation runs according to the present invention as a function of hydrogenation time.

The drawings will be more fully described in the Examples which follow.

DETAILED DESCRIPTION OF THE INVENTION

The initial Iodine Value of the feed oil depends upon the particular choice of oil and can range from as low as 10–25 to as high as 150–210 with some oils having an IV between such IV ranges. Primary hydrogenation in the presence of the catalyst/adjunct catalyst system proceeds at a substantially constant rate and fairly quickly to an intermediate IV at the termination of primary hydrogenation, though as the IV progresses to lower values some loss of rate and protraction of hydrogenation time is experienced.

The intermediate IV depends upon several factors, two of the more influential factors being contaminant soap concentration in the feed oil and initial IV of the feed oil. As to the latter factor, the intermediate IV should be at least about 10% lower than the initial IV of the oil fed to the primary hydrogenation zone. The 10% decrease in IV during primary hydrogenation is particularly applicable to feed oils having initial IV of around 10 to 30 or somewhat higher. For feed oils having initial IV of around 50–100 and especially for oils of around 100–200 IV, there is a rather wide range of intermediate Iodine Values which permit practical and rapid hydrogenation according to the present process. In these cases the intermediate IV can range from as low as 10–20 to about 80–100 and even as high as 130–160 depending upon the chosen feed oil.

Though the intermediate IV of the oil following termination of primary hydrogenation can lie within a broad range of Iodine Values, there is an intermediate IV (or narrow band of intermediate Iodine Values) which appears to optimize the present process. In a specific case, soybeam oil (initial IV of around 134) was hydrogenated in the primary hydrogenation zone to intermediate Iodine Values ranging from about 45 to about 113. All of these runs are within the purview of the present invention with total hydrogenation times for both zones to produce a stearine product (IV of 0–3) withdrawn from the secondary zone ranging from about 0.467 hours to about 0.92 hours (about 28 minutes to about 55 minutes). At an intermediate IV of around 96, though, total hydrogenation time was minimized and the rate of hydrogenation (change in IV per unit time) of the secondary zone maximized. Further on this will be found in the Examples which follow.

The contaminant soap concentration in the feed oil also is an influential factor governing in part the extent of primary hydrogenation, i.e. the intermediate IV of the oil at the termination of primary hydrogenation. Broadly, the intermediate IV is inversely proportional to the concentration of contaminant soap in the oil with higher intermediate Iodine Values permissible at relatively lower soap concentrations and lower intermediate Iodine Values generally advantages at relatively higher soap concentrations. The feed oil for the present process can contain from about 0.003 to about 0.25 weight percent contaminant soap and the present hydrogenation process proceeds substantially insensitively to the soap's presence in the feed oil. Further treatment of this will be found in the Examples which follow.

Several other factors which effect the present process include: contaminants in the feed oil such as phosphatides, iron, free fatty acid and the like; hydrogenation conditions such as temperature and hydrogen gas pressure; concentration of catalysts in each hydrogenation zone; efficiency and extent of catalyst contact with the hydrogen gas an oil, typically controlled by mixing or the like; mode of operation of the process, i.e. batch or continuous operation; and other factors known in the art. Adjustment and balance of these factors can be delicate at times, though proper design of the hydrogenation process can reduce the number of variables to but a few for ease of control and efficiency of the overall process. Precise details of operation of the present process are best determined and correlated for efficient and economic hydrogenation according to the present process.

Several unexpected and surprising benefits are obtained by the present process, some of which while recognized are not fully understood. One such benefit is that the process can handle feed oils, having varying contaminant soap concentrations, efficiently and remain substantially insensitive to such soap. Another benefit is that secondary hydrogenation with only nickel hydrogenation is unexpectedly and substantially improved. A further benefit is that the substantial improvement in secondary hydrogenation (both rate of hydrogenation and time of hydrogenation) and overall short hydrogenation times for both zones are obtained over a wide range of intermediate Iodine Values with optimization of the process achieved at relatively higher intermediate Iodine Values corresponding to shorter primary hydrogenation times. Many other benefits are obtained by the present process as will be clear from the disclosure herein. Referring to primary hydrogenation, generally the adjunct catalyst is present in the zone in an amount of at least about 0.25 weight-percent based on the weight of the oil in the zone for maintaining speed and efficiency of the process. The adjunct catalyst can be present up to about 3 weight-percent or higher depending upon the concentration of soap contaminant in the feed oil. The nickel catalyst is present in the primary hydrogenation zone in an amount of greater than 0.02 weight-percent and this amount can range from about 0.025 to about 0.3 weight-percent or higher. At these higher levels of nickel catalyst, the present process proceeds very rapidly to the chosen intermediate IV level of the oil.

During secondary hydrogenation the concentration of nickel catalyst ranges from about 0.01 to about 0.30 weight-percent, advantageously between about 0.05 to about 0.20 weight-percent, and preferably between about 0.05 and about 0.15 weight-percent. Evidently, the adjunct catalyst in the primary hydrogenation step has sufficiently suppressed the effect of contaminant soap that its need during secondary hydrogenation is eliminated or at least rendered unnecessary and costly.

The nickel hydrogenation catalyst can be in supported or unsupported form for primary and/or secondary hydrogenation. Typical support materials include alumina, silica gel, activated carbon and the like. The nickel catalyst can be made by thermally decomposing nickel formate or other heat-labile nickel salt in fatty oil at about 425–450° F. or by precipitating a nickel salt on an inert carrier followed by reduction with hydrogen gas. The nickel catalyst also can be prepared by the treatment of electrolytically precipitated nickel hydroxide which may be prepared by passing direct current through a cell using nickel as the anode and using a dilute solution of an alkali salt of a weak acid as an electrolyte. The nickel hydroxide so prepared may be conventionally reduced, such as, in the presence of hydrogen gas. The particular manner of preparing the nickel hydrogenating catalyst is not critical to the present invention as the present invention employs those nickel hydrogenation catalysts well known and used in the art today. For present purposes by nickel catalyst is meant the nickel metal content of such catalyst.

The copper chromite adjunct catalyst can be provided in supported or unsupported form. The copper chromite adjunct catalyst can be stabilized with an alkaline earth metal oxide, such as barium oxide or calcium oxide, or with a multivalent metal oxide, such as manganese oxide, although this is not essential. Typically, the oxide stabilizing material ranges from about 4% to 9% by weight of the adjunct catalyst. The molar ratio of the copper to chromite components in the adjunct catalyst is not critical and such components can be in typical amounts as heretofore conventionally used in the hydrogenation art. Typically, the molar ratio of such components is about 1:1. While the nickel catalyst and the adjunct catalyst can be simultaneously deposited on an inert carrier or provided separately in supported form in admixture, it is only essential in the present invention that the catalyst and adjunct catalyst both be present in the primary hydrogenation zone during primary hydrogenation.

Though the catalyst-adjunct catalyst is a synergistic combination in the primary hydrogenation step, it is believed that certain dominant effects can be attributed to each individually in the present process.

The copper-chromite adjunct catalyst appears to act as a soap contaminant suppressant so that its concentration in the hydrogenation zone can be correlated and adjusted broadly proportional to the concentration of soap contaminant (and to a degree the phosphatides and free fatty acid) in the feed oil. The concentration of the adjunct catalyst, however, should be present in an amount of at least about 0.25 weight-percent based on the weight-percent based on the weight of the oil in the primary hydrogenation zone for maintaining the overall speed and efficiency of the hydrogenation process. Generally up to as high as about 3 weight-percent adjunct catalyst can be used for the process. Though higher proportions are permissible, higher costs must be reckoned with. The nickel catalyst, then, appears to act as the prime (though not sole) catalytic agent assisting in the hydrogen absorption by the oil. For overall speed and efficiency of the process, the nickel catalyst should be present at a weight proportion of greater than 0.02 weight-percent and this proportion generally can range from about 0.025 to about 0.3 weight-percent or higher during primary hydrogenation.

Typical sources of the oil are vegetable oil (including nut), animal fat, fish oil and the like. Vegetable oils include the oils of coconut, corn, cottonseed, linseed, olive, palm, palm kernel, peanut, safflower, soybean, sunflower, and like vegetable oils. The oils are refined to remove a variety of impurities therefrom such as free fatty acids, phosphatides, unsaponifiables typically labeled as mucilaginous material, and the like. For purposes of this invention an oil is a full ester of glycerol and fatty acid (triglyceride) which fatty acid has some unsaturation. Preferably the oil is edible.

Alkali-refined oil is prime feedstock for this purpose. Alkali refining of oils is outlined in the following texts; *Kirk-Othmer Encyclopedia of Chemical Technology,* 2nd Edition, Volume 8, pages 798–811 (Interscience Publishers, New York, New York, 1965); and *Bailey's Industrial Oil and Fatty Products,* 3rd Edition, pages 719–896 (Interscience Publishers, New York, New York 1964). These same texts in the passages cited also describe the hydrogenation of oils. These passages are expressly incorporated herein by reference.

Alkali refined oil is a prime feedstock for this process, although it is understood that the oil advantageously can be steam-refined, de-acidified by high vacuum distillation techniques or otherwise refined. Basically, alkali refining comprehends the treatment of the oil with strong (typically 10–20° Baume) caustic soda to remove the foregoing impurities. Usually excess caustic solution (to neutralize all free fatty acids present) is mixed with the oil at about 70–90° F. This causes an emulsion to form. Such emulsion then is heated at about 135–145° F. for breaking it, and the resulting alkali refined oil is recovered by conventional techniques such as filtering, decanting, centrifuging, and the like. By-products formed from the breaking of the emulsion typically include alkali metal soaps of free fatty acids, gums, slimes, and phosphatides. Usually these are sent to a separate recovery treatment, eg. springing fatty acids from the soaps. For present purposes, the instant process operates efficiently and economically on all typical alkali refined oils regardless of the particular alkali refining process employed.

The instant hydrogenation reduces the number of ethylenic linkages in the fatty acid chains to obtain even comparative low I.V. materials, and can be used to get practical saturation of such linkages. As practiced commercially, the hydrogenation of oils is a liquid phase process in which gaseous hydrogen is dispersed in the heated oil under the influence of a solid catalyst. Though continuous hydrogenation methods have been practiced, most present day commercial hydrogenation operations employ a batch process with particulate hydrogenation catalyst, which catalyst generally is separated from the product hydrogenated oil.

Hydrogenation operations for the instant invention comprise charging the alkali refined oil into a hydrogenation reactor having a hydrogenation zone therein. Hydrogenation conditions for contacting hydrogen gas with the oil typically include temperatures of about 100° to about 300° C. and pressures of about 0 to about which consists of a cylindrical vessel provided with a hydrogen distributor at the bottom through which an excess quantity of hydrogen gas is blown through the oil in the hydrogenation zone. Another typical hydrogenation reaction is the dead-end system which employs a cylindrical pressure vessel with a mechanical agitator of the gas-dispersion type which is supplied from high pressure hydrogen gas storage tanks at the rate and in the volume actually used and leaked. A variety of other hydrogenation reactors are commercially employed and likwise beneficially hydrogenate the oil.

In the present process the total reaction is terminated when the Iodine Value of the product is determined to be within specifications for the particular product being made. The Iodine Value of the primary and secondary zones contents can be determined routinely by monitoring an indicia correlative to the Iodine Value of the contents, such as refractive index measurements, ultraviolet or infrared absorption techniques, and the like.

The present hydrogenation process can be performed quite advantageously on a continuous basis. Generally, the catalysts are separated from each other and the intermediate hydrogenated product from both catalysts by a variety of schemes. Typical schemes include holding one catalyst as a fixed bed in the hydrogenation zone while allowing the other catalyst to be freely dispersed in the oil, or providing one catalyst in supported form and the other catalyst in unsupported form for easy screening separation. Various schemes also include reuse of the nickel catalyst from the primary hydrogenation step for secondary hydrogenation while separating adjunct catalyst therefrom.

The standard and preferred method for determining the concentration of soap in a glyceride oil is the American Oil Chemists Society test method AOCS CC 15–60. Another method that gives essentially the same results, and the one that was used in connection with the following examples, is outlined below. This method is a modified version of the procedure reported by Wolff at Chem. Abstracts, 42,6243 (1948).

A solvent body is prepared from 50% by weight ethanol, 35% by weight dioxane and 15% by weight water to which is added bromophenol blue (25 mg color indicator per 1 liter solvent body). The color of the solvent body then is adjusted to yellow by the addition of 0.1N hydrochloric acid. A weighed sample of soap-contaminated oil, 5 to 50 grams, is added to 100 ml of the color-adjusted solvent body, and the agitated oil/-solvent body mixture warmed at atmospheric pressure to a temperature sufficient to assist dissolving the oil therein. A larger oil sample is used when a lower soap concentration is expected, and a smaller sample is used when a higher soap concentration is expected. The presence of soap will cause the oil/solvent body to turn green. The agitated, heated oil/solvent body solution then is titrated with 0.02N or 0.1N hydrochloric acid until a yellow color reappears. The more concentrated acid is used for samples expected to contain a higher soap concentration, and the less concentrated acid is used when smaller soap concentrations are expected.

For oils predominating in $C_{18}$ fatty acid equivalent content, such as soybean oil, and when the soap is a sodium salt of fatty acid due to a sodium base (alkali) refining operation of the oil, the concentration of soap in the oil conventionally is calculated as follows (the constant 304,000 treating the soap as though it were totally sodium oleate):

$$\text{ppm soap (as sodium oleate)} = \frac{(304{,}000)(\text{normality of HCl})(\text{ml of HCl titrated})}{\text{weight of oil sample in grams}}.$$

The constant in the foregoing formula, of course, would be different for oils predominating in fatty acid content of different chain lengths (eg. palm kernel oil which predominates in $C_{12}$ fatty acids) and for oils refined with other alkalis (eg. a potassium or ammonium base).

The following examples show in detail how the present invention can be practiced, but they should not be construed as limiting the scope of the present invention. In this specification all percentages and proportions are by weight, all temperatures in degrees Centigrade, and all mesh sizes in United States Standard Sieves Series, unless otherwise expressly indicated. Also, all catalyst weight-percentages herein are based on the weight in a zone of the oil subject to hydrogenation unless otherwise expressly indicated.

EXAMPLES

In all runs the feed oil was from lots of alkali refined soybean oil taken from an edible oil refinery operating in this country. Typical analysis of one feed oil representative of all oils used herein (unless otherwise expressly indicated) is given below.

| Fatty Acid Content (Chain length: no. of double bonds) | Weight-Percent |
|---|---|
| C14:0 | 0.1 |
| C16:0 | 11.0 |
| C17:0 | 0.1 |
| C18:0 | trace |
| C18:0 | 4.1 |
| C18:1 | 22.8 |
| C18:2 | 54.3 |
| C18:3 | 7.6 |
| Iodine Value | 133.6 |
| Free Fatty Acid Content | 0.04 wt-% |
| Iron | 0.47 ppm |
| Phosphatides | 38 ppm |
| Water | 0.01 wt-% |
| Color | 8Y-.7R |
| Soap (as sodium oleate) | 0.003 wt-% |

All hydrogenation runs were conducted in a two liter pressure vessel equipped with a variable speed stirred agitator and fitted with a pressure guage and electrical heaters. In the primary stage, the feed oil and catalyst were charged to the vessel, the vessel evacuated of air and its contents preheated to 100° C. Primary stage hydrogenation then was conducted. Upon termination of the primary stage the catalyst system was removed from the oil and fresh catalyst added for secondary hydrogenation.

The Iodine Values (IV) of the oils were monitored throughout the runs and periodically samples were removed for analysis as reported herein. Hydrogenation conditions for primary hydrogenation included temperatures of 100–230° C., and hydrogen gas pressures of 40–60 psi. Similar conditions were employed for secondary hydrogenation except that the temperature ranged from about 200–250° C. The adjunct catalysts were copper chromite (about 1:1 molar ratio of copper content to chromium content) stabilized with 7–8% (by weight of the adjunct catalyst) of barium oxide (Code 102 and Code 108 copper chromite catalysts supplied by Calsicat Division of Mallinckrodt, Inc.; and Code 477A-26-3-21P copper chromite catalyst supplied by Harshaw Chemical Company). The nickel catalysts were fully active nickel on a support and protected in stearine (*NYSEL HK-4 nickel catalyst supplied by Harshaw Chemical Company).

*NYSEL is a registered trademark of Harshaw Chemical Company.

EXAMPLE 1

A commerically refined soybean oil substantially similar in composition to the forgoing described oil was hydrogenated in a two step process according to the present invention. In all runs, the primary hydrogenation step used 0.025 weight-percent nickel hydrogenation catalyst and 1.0 weight-percent copper chromite adjunct catalyst while the secondary zone used 0.1 weight-percent nickel hydrogenation catalyst. The oil contained about 0.003 weight-percent soap in runs 1-5 and about 0.11 weight-percent soap in run 6. The intermediate Iodine Values at the termination of the primary hydrogenation stage varied as set forth below in Table I which summarizes the results obtained.

TABLE 1

| | Primary Stage | | Secondary Stage | | Both Stages | | Total Time |
|---|---|---|---|---|---|---|---|
| Run No. | Intermediate IV | Time (hrs) | Final IV | Time (hrs) | Time (hrs) to 30 IV | Time (hrs) to 3 IV | (hrs) to 0 IV |
| 1 | 113.1 | 0.3 | 0 | 0.333 | 0.453 | 0.558 | 0.633 |
| 2 | 95.8 | 0.3 | 0 | 0.167 | 0.367 | 0.386 | 0.467 |
| 3 | 83.0 | 0.38 | 0 | 0.25 | 0.54 | 0.62 | 0.63 |
| 4 | 72.3 | 0.5 | 0 | 0.42 | 0.64 | 0.75 | 0.92 |
| 5 | 44.5 | 0.58 | 0 | 0.25 | 0.66 | 0.83 | 0.83 |
| 6 | 15.2 | 1.0 | 0 | 0.25 | 0.87 | 1.25 | 1.25 |

The above-tabled results clearly show the extremely short hydrogenation times obtained to produce a stearine by the instant process. Run 6 in particular is important as it shows the flexibility of the instant process in making a stearine in surprisingly rapid fashion even from a severely soap contaminated oil.

FIG. 1 portrays the results obtained in Table I graphically. Except for run 6 in which a high soap-contaminated oil was used, runs 1–5 show an interesting trend which was discovered—the higher the intermediate IV at the termination of the primary hydrogenation step, the shorter the overall hydrogenation times to reach an IV of around 0-3.

Figure 2:
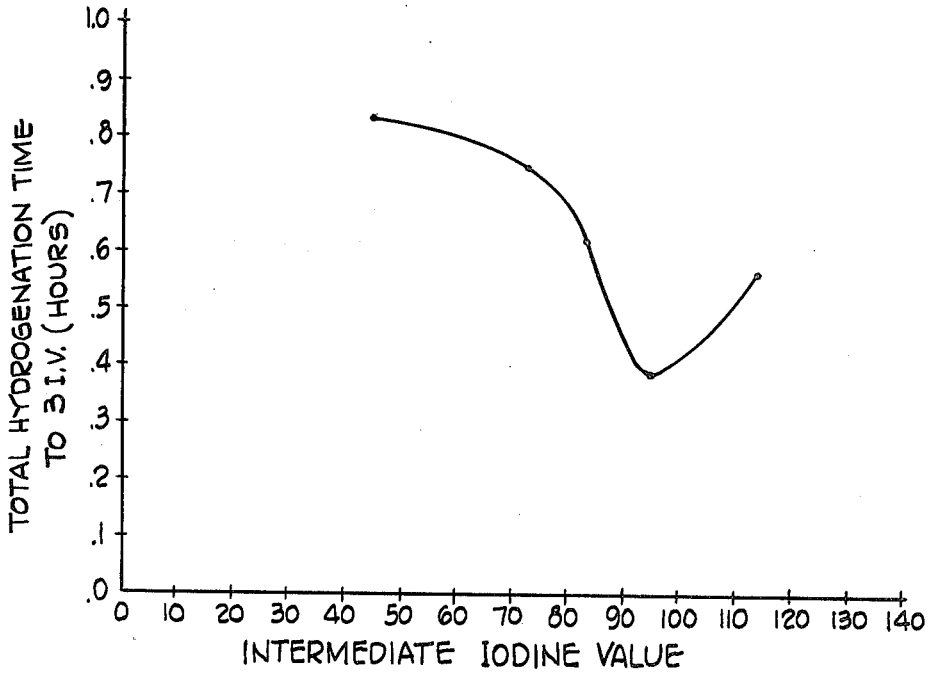
FIG. 2 is a scaled graph indicating the intermediate Iodine Value at the termination of primary hydrogenation of five of the runs shown in FIG. 1 as a function of total hydrogenation time to an Iodine Value of 3 of the stearine products.

FIG. 2 portrays graphically this discovery by a plot of the intermediate IV versus total hydrogenation time to a 3 IV for runs 1–5. Clearly shown in FIG. 2 is an inflection point on the curve where the overall hydrogenation time is at a minimum. Surprisingly, this point occurs at a relatively high IV which corresponds to a shorter time of primary hydrogenation. Quite unexpectedly, shorter times of hydrogenation in the primary zone up to a point using the extremely active nickel/copper chromite catalyst combination permits overall shorter hydrogenation times for both stages, the secondary stage using a less active and soap-sensitive nickel hydrogenation catalyst alone.

Another unexpected benefit shown in FIG. 1 is that the rate of hydrogenation in the secondary zone using only nickel catalyst is dramatically increased by use of the primary hydrogenation step and such rate gets progressively greater at each higher intermediae IV. Table II shows the rates of hydrogenation obtained in runs 1–5. All rates shown are change in IV per hour.

TABLE II

| Run No. | Primary Stage | Secondary Stage | To 30 IV | To 3 IV | Overall |
|---|---|---|---|---|---|
| 1 | 56.33 | 339.64 | 220.75 | 227.60 | 205.37 |
| 2 | 114.0 | 573.65 | 272.48 | 329.02 | 278.37 |
| 3 | 123.7 | 332.0 | 185.2 | 204.8 | 206.4 |
| 4 | 115.4 | 172.1 | 156.3 | 169.3 | 141.3 |

TABLE II-continued

| Run No. | Primary Stage | Secondary Stage | To 30 IV | To 3 IV | Overall |
|---|---|---|---|---|---|
| 5 | 147.41 | 178.0 | 151.5 | 153 | 156.6 |

The above-tabled results again show maximization of the process—maximum rate of IV change per hour—in run 2. Surprisingly, these results show extremely high rates of hydrogenation in the secondary zones using only nickel hydrogenation catalyst and the highest rates for run 2 which run also gave the overall shortest hydrogenation time. It is believed that results substantially similar to those reported in the foregoing tables would be obtained for oils more soap-contaminated, except that the inflection point (or point of maximization of the process for the intermediate IV) would progressively decrease with increasing levels of contaminant soap though there is a wide range of intermediate IVs at which the process favorably operates, there appears to be an intermediate IV at the upper end of this range which optimizes the process.

EXAMPLE II

Several comparative hydrogenation runs were conducted on several different soybean oil lots, each of which contained about 0.003 weight-percent contaminant soap. The various processes and catalysts employed are summarized below.

A. Two-stage hydrogenation with the catalyst systems reversed from the order used in Example I, i.e. 0.1 weight-percent nickel catalyst in the primary stage and nickel/copper chromite catalysts (0.025/1.0 weight-percent respectively) in the secondary stage. The average of 7 runs is reported.

B. One-stage hydrogenation with only 0.1 weight-percent nickel hydrogenation catalyst. The average of 4 runs is reported.

C. One-stage hydrogenation with 0.025 weight-percent nickel catalyst and 1.0 weight-percent copper chromite adjunct catalyst.

D. Two-stage hydrogenation with 0.1 weight-percent fresh nickel catalyst in each stage. The average of two runs is reported.

Figure 3:
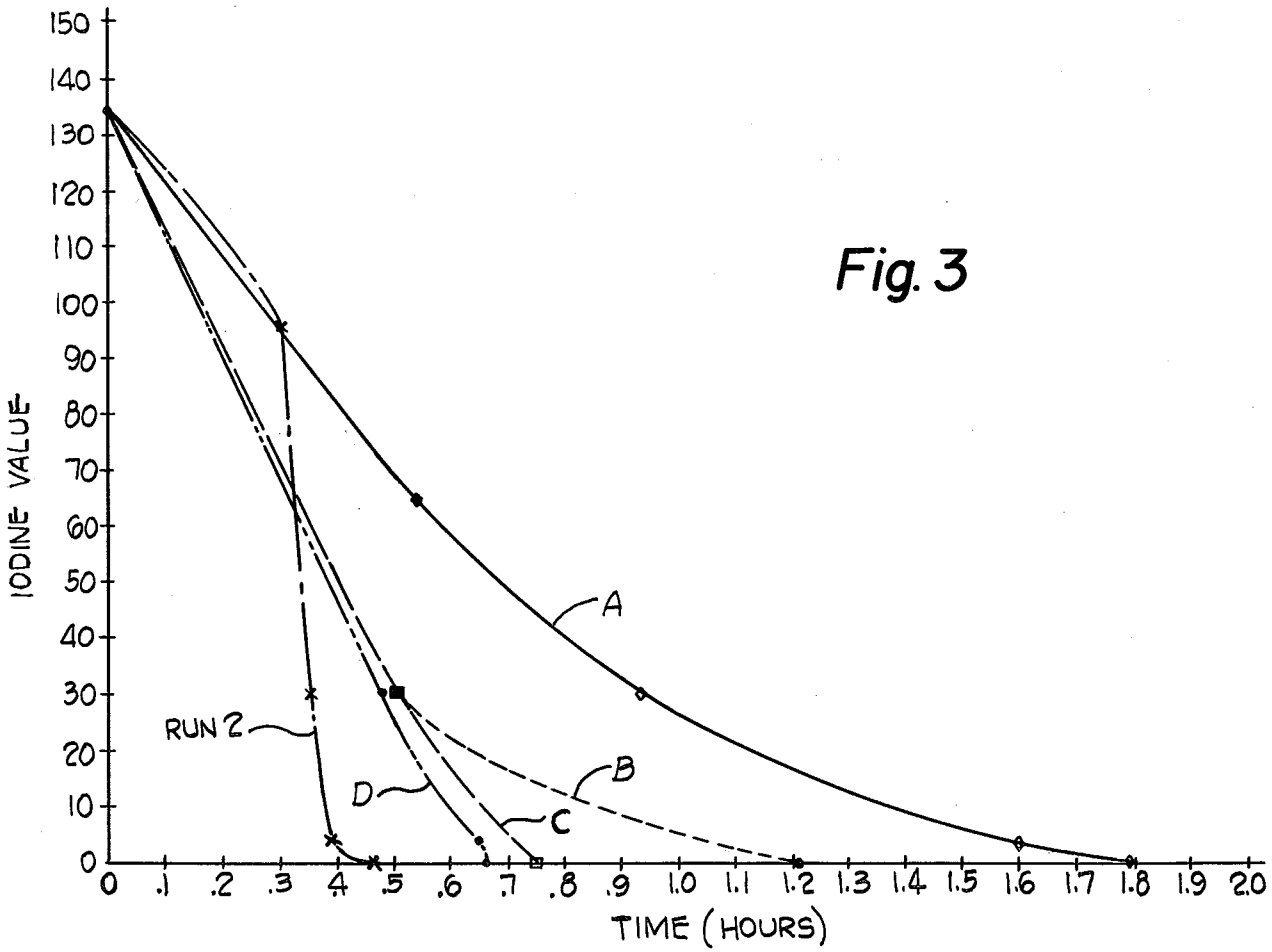
FIG. 3 is a scaled graph indicating the Iodine Value obtained in a series of comparative hydrogenation runs and run 2 of FIG. 1 as a function of hydrogenation time.

The results obtained from the foregoing hydrogenation runs are depicted graphically in FIG. 3 along with run 2 of Example I (run 2 being the best operating mode of the present invention).

There is some improvement in staging hydrogenation for use of only nickel hydrogenation catalyst. Since the nickel catalyst is rendered inactive by contaminant soap, multiple use of fresh nickel catalyst can only benefit the overall hydrogenation process. Yet, even with such staging, hydrogenation times and rates of hydrogenation (most notably in the secondary stage) are not nearly as favorable as those of the present process. Reversing the order of the catalyst systems in the two stages does not give the same exceptional results as are obtained in the present process as run A indicates. Also, use of only nickel hydrogenation catalyst (equivalent to a zero time primary stage and only use of the secondary stage) and use of only the nickel copper chromite catalyst combination (equivalent to a zero time secondary stage and only use of the primary stage) do not give comparable results as are obtained by the present process as shown in Runs B and C.

The superiority of the present invention is even more pronounced as the level of contaminant soap in the feed oil is increased. The following comparative hydrogenation runs were conducted on lots of soybean oil each containing about 0.11 weight-percent contaminated soap.

B' One-stage hydrogenation with 0.1 weight-percent nickel catalyst (average of 4 runs reported in Example 3 of U.S. Ser. No. 733,348).

P. One-stage hydrogenation with 1.0 weight-percent copper-chromite catalyst (average of 5 runs reported in Example 3 of U.S. Ser. No. 733,348).

Figure 4:
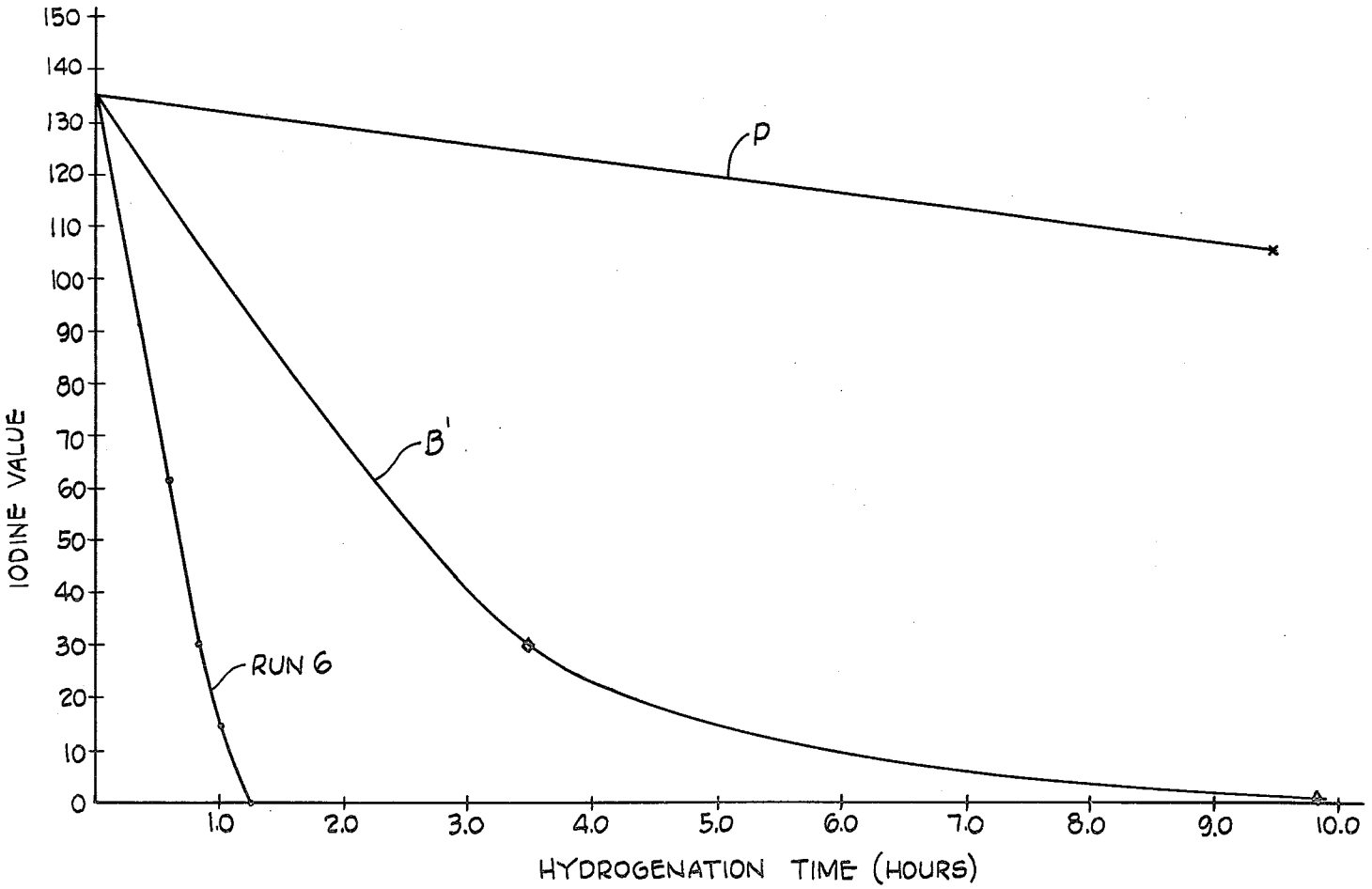
FIG. 4 is a scaled graph indicating the Iodine Value obtained in a series of comparative hydrogenation runs and Run 6 of FIG. 1 as a function of hydrogenation time.

The results obtained from the foregoing hydrogenation runs and Run 6 of Example I are depicted graphically in FIG. 4.

While runs B and B' are substantially identical except for the increased level of soap contaminant in the feed oil, the results are far from being identical. The effect of contaminant soap on hydrogenation times is clear—hydrogenation time to about 0 IV is increased from about 1.2 hours in Run B to almost 10 hours in Run B'. However, hydrogenation time for the present invention is increased from about 0.467 hours in Run 2 to only about 1.25 hours in Run 6. The rate of hydrogenation also is maintained substantially constant (and rather high) in the present process, whereas below an IV of 30, Run B' shows a substantially decreased hydrogenation rate and corresponding protracted hydrogenation time.

Multiple staging of nickel catalyst for Run B' may decrease the overall hydrogenation time (and perhaps even to around 5 to 6 hours), though this is unconfirmed. Still the superiority of the present invention would remain. Run P is given to show that under the present hydrogenation conditions, copper chromite catalyst alone is incapable of catalytically hydrogenating the feed oil, to any significant degree, less than to about a 100 IV and still only after an unacceptably long time of hydrogenation.

The foregoing results indicate not only superiority of the present process, but unexpected superiority of the process. The present process permits production of stearines from even severely soap-contaminated oil in extremely rapid fashion. Also, for a given soap level there appears to be an optimum intermediate IV at the termination of the primary stage at which total hydrogenation time is minimized and overall rate of hydrogenation maximized, and rate of hydrogenation in the secondary zone unexpectedly and dramatically increased and maximized.

I claim:

1. A process for the hydrogenation of a glyceride oil wherein the resulting hydrogenated product has an Iodine Value (IV) not substantially above about 30, comprising subjecting said oil to primary hydrogenation in a primary hydrogenation zone with hydrogen gas under hydrogenation conditions in the presence of greater than 0.02 weight-percent nickel hydrogenation catalyst and of greater than about 0.25 weight-percent copper-chromite adjunct catalyst, said catalyst weight-percentages based on the weight of said oil in said primary zone;

establishing and maintaining the concentration of said adjunct catalyst in said primary zone broadly proportional to the soap concentration in said oil, said soap concentration being from about 0.003 to about 0.25 weight-percent by weight of said oil;

discontinuing said primary hydrogenation at an intermediate Iodine Value (IV) of the oil in said primary zone of at least about 10% less than the Iodine Value (IV) of the oil fed to said primary zone;

separating at least said adjunct catalyst from said oil;

subjecting said primary hydrogenated oil to secondary hydrogenation in a secondary hydrogenation zone with hydrogen gas under hydrogenation conditions in the presence of about 0.01 to about 0.3 weight-percent nickel hydrogenation catalyst based on the weight of said oil in said secondary zone;

discontinuing said secondary hydrogenation when the Iodine Value (IV) of the oil in said secondary zone is less than said intermediate Iodine Value and not substantially above about 30; and withdrawing said resulting hydrogenated product from said secondary hydrogenation zone.

2. The process of claim 1 wherein for primary hydrogenation the proportion of nickel catalyst ranges from about 0.025 to about 0.3 weight-percent and said adjunct catalyst ranges from about 0.25 to about 3 weight-percent

3. The process of claim 2 wherein said adjunct catalyst ranges from about 1 to about 3 weight-percent.

4. The process of claim 1 wherein said adjunct catalyst is metal oxide stabilized.

5. The process of claim 1 wherein said metal oxide is barium oxide or manganese oxide.

6. The process of claim 1 wherein said oil is admitted continuously into said primary hydrogenation zone and said resulting hydrogenated product is continuously withdrawn from said secondary hydrogenation zone.

7. The process of claim 6 wherein the Iodine Value of the oil in at least one of said hydrogenation zones is monitored continuously near an outlet in at least one of said zones and at least one adjustable hydrogenation condition of said monitored zone is adjusted in response to variation of said indicia and to a degree adequate for maintaining said indicia, thus the corresponding Iodine Value (IV) of the contents of said monitored zone, substantially constant.

8. The process of claim 1 wherein for secondary hydrogenation said nickel catalyst ranges from about 0.10 to about 0.3 weight-percent.

9. The process of claim 8 wherein said nickel catalyst ranges from about 0.10 to about 0.20 weight-percent.

10. The process of claim 1 wherein said withdrawn resulting hydrogenated product has IV not substantially above about 20.

11. The process of claim 10 wherein said IV is not substantially above about 10.

12. The process of claim 11 wherein said IV is between about 0 and about 5.

13. The process of claim 1 wherein said primary hydrogenation zone and secondary hydrogenation zone are the same zone.

14. A process for the hydrogenation of a glyceride oil contaminated with between about 0.003 and about 0.25 weight-percent soap, wherein the resulting hydrogenated product has an Iodine Value (IV) not substantially above about 30, comprising:

subjecting said oil to primary hydrogenation in a primary hydrogenation zone with hydrogen gas under hydrogenation conditions in the presence of between about 0.025 and about 0.3 weight-percent nickel hydrogenation catalyst and of between about 0.25 and about 3 weight-percent copper chromite adjunct catalyst, said catalyst weight-percentages based on the weight of said oil in said primary zone;

establishing and maintaining the concentration of said adjunct catalyst in said zone broadly proportional to the soap concentration in said oil in said primary hydrogenation zone;

discontinuing said primary hydrogenation at an intermediate Iodine Value (IV) of the oil in said primary zone of between about 10 and about 120;

separating at least said adjunct catalyst from said oil;

subjecting said primary hydrogenated oil to secondary hydrogenation in a secondary hydrogenation zone with hydrogen gas under hydrogenation conditions in the presence of about 0.01 to about 0.3 weight-percent nickel hydrogenation catalyst based on the weight of said oil in said secondary zone;

discontinuing said secondary hydrogenation when the Iodine Value (IV) of said oil in said secondary zone is less than said intermediate Iodine Value (IV) and not substantially above about 30; and withdrawing said resulting hydrogenated product from said secondary hydrogenation zone.

* * * * *

UNITED STATES PATENT AND TRADEMARK OFFICE

CERTIFICATE OF CORRECTION

PATENT NO. : 4,158,666

DATED : June 19, 1979

INVENTOR(S) : John M. Hasman

It is certified that error appears in the above-identified patent and that said Letters Patent are hereby corrected as shown below:

Column 4, line 21, change "9%" to---8%---.

Column 5, line 51, before "which", insert ---100 psig. Typical hydrogenation reactors include the hydrogen recirculation type--- .

Signed and Sealed this

*Eleventh* Day of *September 1979*

[SEAL]

*Attest:*

*Attesting Officer*

LUTRELLE F. PARKER

*Acting Commissioner of Patents and Trademarks*